United States Patent [19]

Owen

[11] Patent Number: 4,689,841

[45] Date of Patent: Sep. 1, 1987

[54] FOLDAWAY SINK

[76] Inventor: Gregory M. Owen, 2919 E. Elm Cir., Katy, Tex. 77449

[21] Appl. No.: 914,271

[22] Filed: Oct. 2, 1986

[51] Int. Cl.[4] ..... E03C 1/322

[52] U.S. Cl. ..... 4/644; 4/638; 4/646

[58] Field of Search ..... 4/627, 630, 631, 638, 4/643, 644, 646, 654

[56] References Cited

U.S. PATENT DOCUMENTS

| | | | |
|---|---|---|---|
| 950,691 | 3/1910 | Firth | 4/646 X |
| 964,857 | 7/1910 | Fredenhagen | 4/638 |
| 2,594,938 | 4/1952 | Leavitt | 4/638 X |
| 2,989,756 | 6/1961 | Catson | 4/627 |
| 3,292,966 | 12/1966 | Mariol | 4/644 X |

FOREIGN PATENT DOCUMENTS

| | | | |
|---|---|---|---|
| 24960 | of 1906 | United Kingdom | 4/631 |

*Primary Examiner*—Charles E. Phillips

[57] ABSTRACT

A foldaway sink pivotally connected to a supporting wall for movement between a retracted position parallel to the supporting wall and a position perpendicular to the supporting wall. The sink is made of fiberglass with a ribbed edge. A drain pipe and a support pipe are disconnectable and releasably attachable to the side of the sink in the retracted position.

10 Claims, 4 Drawing Figures

FOLDAWAY SINK

FIELD OF THE INVENTION

This invention relates to sinks, and more particularly, to a foldaway sink having a work surface and detachable components and which is pivotally connected to a support wall for storage when not in use.

BACKGROUND OF THE INVENTION

While there are many foldaway systems such as ironing boards, beds and so forth, heretofor, there has been no practical foldaway system for outdoor sinks and providing a working surface for field dressing game and fish.

Hunters and fishermen, in particular, obtain game and fish requiring cleaning or scaling. Conventional sinks are not designed nor are they suitable for cleaning operations requiring use of a knife proximate to the sink top surface. Outdoor sink arrangements typically are available only at a permanent installation such as a hunting or fishing lodge and utilize conventional sinks. Individuals having occasional or infrequent use of a game sink have a need for a practical game sink which can be used outdoors and does not involve extensive planning for set up and operation and can be stored when not in use.

THE PRESENT INVENTION

The present invention is embodied in a fiberglass constructed sink member which is generally rectangular having four sides and a substantially flat upper working surface. The working surface has a circumferential edge configuration with an upwardly facing drain groove. A water supply connection is attached to the upper working surface by a strap member and includes a threaded connection for a garden hose, a control valve and a short piece of flexible outlet tubing. The working surface has a conventional drain opening with a threaded drain connection located under the working surface. A tubular pipe drain with a threaded coupling is releasably attachable to the drain connection. The tubular pipe drain, intermediate of its length, has a snap type connector which cooperates with a snap connector on an side surface. When the pipe drain is disconnected from the threaded drain connection, it can be releasably snap connected to an side surface for storage. One side surface is provided with a set of hinges so that the one side surface can be pivotally coupled to a vertical base support by screws or bolts. In one pivoted position, the working surface is parallel to the base support and out of the way for storage purposes. In the other pivoted position, the working surface is perpendicular to the vertical base support for working conditions. On the underside of the working surface are one or more blind openings which receive one or more support pipes. A support pipe or press are provided with a snap connection which releasably attaches a support pipe to an side surface when the sink is not is use.

THE DRAWINGS

DESCRIPTION OF THE INVENTION

Figure 1:
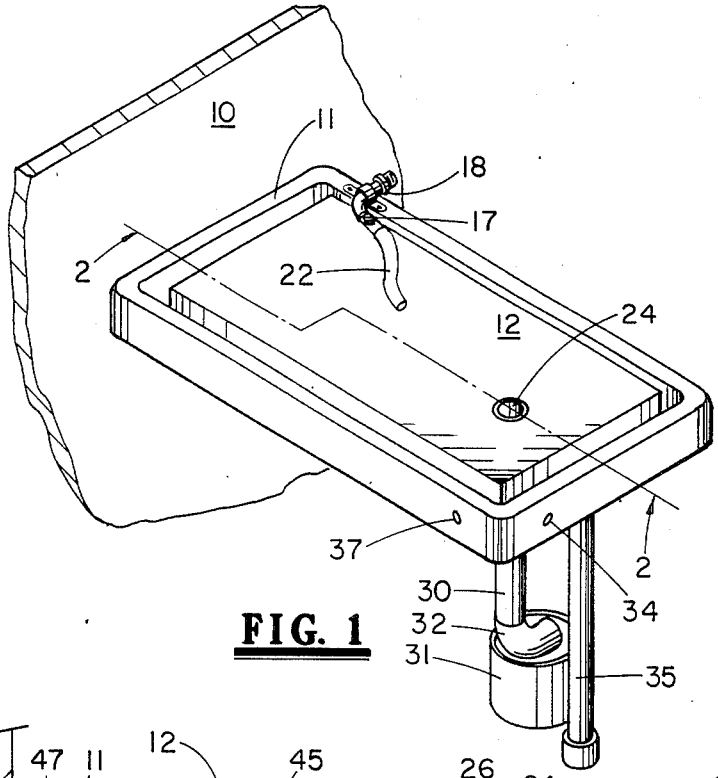
FIG. 1 illustrates a perspective view of a foldaway sink attached to a supporting wall.
Figure 2:
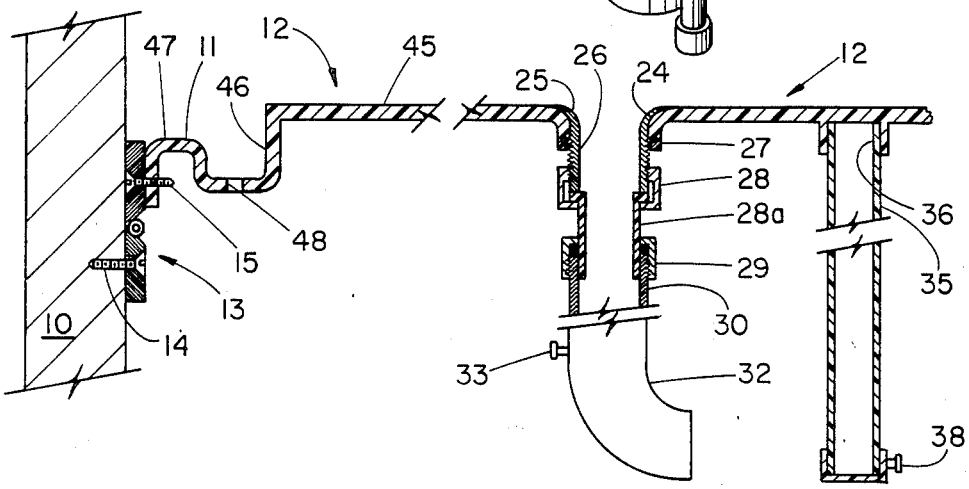
FIG. 2 is a view in cross-section taken along line 2—2 of FIG. 1.

Referring now to FIG. 1 the overall configuration of the system is illustrated in which a vertical support wall 10 is utilized to pivotally support one side surface 11 of a sink member 12. A pivot hinge 13 is shown in FIG. 2 and is attached by screws or bolts 14 to the vertical support wall 10 and is secured by screws or bolts 15 to the side surface 11 of the sink member 12. Thus, the sink member 12 may be positioned in a location perpendicular to the vertical support wall 10 and pivoted by the hinge 13 to a position substantially parallel to the vertical support wall 10. The location of two or more hinges 13 on the support wall 10 is at a suitable distance above the ground level so that the length of the sink member 12 can be accommodated in a parallel position to the support wall 10 when the various supporting and drain attachments are removed.

Figure 3:
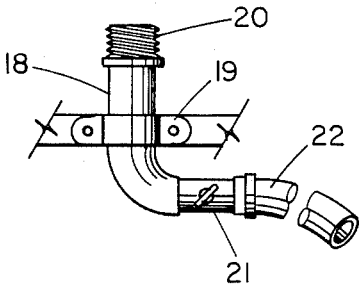
FIG. 3 is a top view showing connection of a coupling to the top of the sink.

In one corner 17 of the sink member 12, near the hinged side surface 11, is an elbow connection 18 which is attached to the sink member 12 or to an upper surface by a suitable strap 19 (See FIG. 3). The elbow connection 18 has a threaded inlet opening 20 for attachment to a garden hose (not shown), a valve member 21 for controlling fluid flow through the coupling and a flexible discharge hose 22 which extends a sufficient distance over the sink member 12 for supplying a source of water for cleaning operations.

At the opposite end of the sink member 12 from the hinge connection is a drain opening 24 which is sized to receive a conventional annular sink flange 25 where the flange has a tubular portion 26 inserted through the drain opening and is ridgedly attached by a nut and threaded connection 27 on the underside of the sink member. The tubular portion 26 also provides an external threaded connection for a drain pipe coupling 28. On the tubular end 28*a* of the coupling 28 is a nut and expansion washer 29 which threadedly connects to a drain pipe 30. The drain pipe 30 extends downwardly from the sink member to a elbow coupling 32 located just above the level for a pail or other receptacle 31 for receipt of fluid discharge from the sink member. The drain pipe 30 is releasable by virtue of a thread nut coupling 28 to the tubular portion. On the elbow coupling 32 on the drain pipe is an outer snap connection 33. The outer snap connection is adapted to cooperate with a complimentary snap member 34 which is affixed to one surface of the sink member. Thus, when the drain pipe is detached from the sink member, it can be stored in an attached position on a side surface of the sink member.

The outer end of the sink member 12 is supported by a tubular support member 35 which rests against a ground surface and has its upper end slidably received in a cylindrically shaped blind opening 36 on the underside of the sink member 12. Thus, the support member is removable from the sink member. The support member 35 is also provided with a snap member 38 which cooperates with a snap member 37 on a side surface of the sink member for storage when the sink is not in use. The snap members for components can be on any or all of the side surfaces and more than one snap member can be utilized.

For disassembly from the assembled position shown in FIG. 1, the drain pipe 30 is threadedly uncoupled from the sink member and the sink member is lifted a sufficient distance to remove the support member 35 from the blind opening 36. Then the sink member 12 is then pivoted about the hinges to a substantially parallel position relative to the vertical supporting wall. The drain pipe 30 and support member 35 are attached by the snap members to side surfaces of the sink member. Thus the entire assembly is stored in a vertical position.

Figure 4:
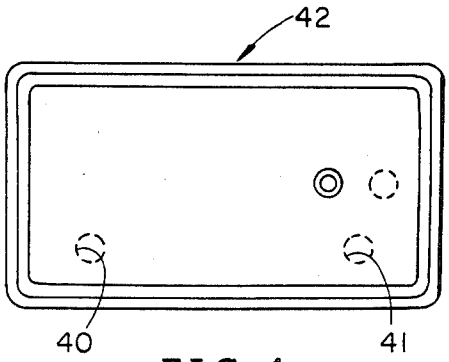
FIG. 4 is a top view of a sink showing multiple leg sockets.

As shown in FIG. 4, two support members (not shown) can be used to be received in corresponding blind openings 40, 41 in the bottom surface of a sink member to accommodate sink members having substantial width. In this instance the sink member is pivoted along the side surface 42.

As shown in FIG. 2, the sink member has a substantially flat upper surface 45 with a U-shaped trough 46 around its circumference and a curved outer lip surface 47 which provides rigidity to the sink structure. The sink itself is made of fiberglass and the trough may be provided with suitable openings 48 for drainage, as desired.

The top 45 of the sink member is preferably located above the top of the lip surfaces 47 of the sink member which facilitates use of a working tool such a knife for fileting fish. The top of the sink member is preferably at least one quarter inch above the outer supporting lip surfaces 47 of the sink member.

From the foregoing, it can be appreciated that an outdoor fold away sink is provided which is attachable to a source of water from a garden hose and can be easily assembled with respect to the vertical supporting member for use when desired and can be disassembled and maintained in a compact, interconnected unit when not in use. All of the parts save for metal fittings are preferably made out of fiberglass or PVC material which will not rust and will resist corrosion.

It will be apparent to those skilled in the art that various changes may be made in the invention without departing from the spirit and scope thereof and therefore the invention is not limited by that which is enclosed in the drawings and specifications, but only as indicated in the appended claims.

I claim:

1. A foldaway sink comprised of an elongated sink member having a substantially flat central surface, said sink member having a generally rectangular configuration with four side surfaces, means on one of said side surfaces for pivotally coupling said one side surface to a vertical base member, means defining a drain opening in said central surface and including threaded coupling means disposed below said central surface for attaching a drain pipe, a tubular drain pipe with means for releasably attaching to said threaded coupling means, first attachment means on said drain pipe and on a side surface of said sink for attachment of said drain pipe to said side surface when said sink is pivoted to a non-use position, means defining a blind opening on the bottom surface of said sink member for releasably receiving a support pipe, a tubular support pipe receivable in said opening, said support pipe having a second attachment means thereon adapted to cooperate with a second attachment means on a side surface of said sink for attachment of said support pipe to said side surface when said sink is pivoted to said non-use position.

2. A sink as defined in claim 1 wherein said first and second attachment means are releasable snap connectors.

3. A sink as defined in claim 1 and further including a supply pipe attached to the sink, said supply pipe having an inlet attachment means for releasably coupling to a flexible supply hose and having an outlet attachment means for releasably coupling to a flexible discharge hose.

4. A sink as defined in claim 3 and further including a valve member coupled between an attachment means and the supply pipe for controlling flow of liquid through said supply pipe.

5. The sink as defined in claim 1 wherein said drain pipe is shorter in length than the length of said support pipe for providing a discharge above a ground surface.

6. The sink as defined in claim 1 wherein said sink member is constructed of fiberglass and said drain pipe and support pipe are constructed from PVC material.

7. A foldaway sink comprised of an elongated sink member having a substantially flat central surface and a circumferential lip configuration providing a circumferential upwardly facing groove, said sink member having a generally rectangular configuration with four side surfaces, means on one of said side surfaces for pivotally coupling said one side surface to a vertical base member, means defining a drain opening in said central surface and including threaded coupling means disposed below said central surface for attaching a drain pipe, a tubular drain pipe with means for releasably attaching to said threaded coupling means, first attachment means on said drain pipe and on a side surface of said sink for attachment of said drain pipe to said side surface when said sink is pivoted to a non-use position, means defining a blind opening on the bottom surface of said sink member for releasably receiving a support pipe, a tubular support pipe receivable in said opening, said support pipe having a second attachment means thereon adapted to cooperate with a second attachment means on a side surface of said sink for attachment of said support pipe to said side surface when said sink is pivoted to said non-use position.

8. The sink member as defined in claim 7 wherein said lip configuration includes an outer circumferential downwardly facing groove disposed outwardly of said circumferential upwardly facing groove, said central surface being offset with respect to said downwardly facing groove and said central surface so that said central surface is located above said downwardly facing groove when said central surface is in a horizontal position.

9. The sink member as defined in claim 8 and further including hinge means on a side surface for pivotally connecting said sink member to a support wall.

10. The sink member as defined in claim 8 wherein said sink member is constructed of fiberglass and said drain pipe and support pipe are constructed from PVC material.

* * * * *